US006966637B2

(12) United States Patent
Ishizaki

(10) Patent No.: US 6,966,637 B2
(45) Date of Patent: Nov. 22, 2005

(54) INK JET CARTRIDGE

(75) Inventor: Akemi Ishizaki, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 167 days.

(21) Appl. No.: 10/730,808

(22) Filed: Dec. 8, 2003

(65) Prior Publication Data

US 2004/0174419 A1 Sep. 9, 2004

(30) Foreign Application Priority Data

Dec. 9, 2002 (JP) ..... 2002-356254

(51) Int. Cl.[7] ..... B41J 2/175
(52) U.S. Cl. ..... 347/85; 347/87
(58) Field of Search ..... 347/85, 86, 87; 141/2, 18

(56) References Cited

U.S. PATENT DOCUMENTS 6,474,797 B2 * 11/2002 Kurata et al. ..... 347/85
6,612,683 B2 * 9/2003 Takahashi et al. ..... 347/30
6,637,872 B2 * 10/2003 Ara et al. ..... 347/85

* cited by examiner

*Primary Examiner*—Anh T. N. Vo
(74) *Attorney, Agent, or Firm*—Morgan & Finnegan, LLP

(57) ABSTRACT

An ink jet cartridge includes an ink jet recording head; an ink container for containing ink to be supplied to the recording head; an ink supply source connecting portion which is provided in the ink container and which is connectable with an ink supply source to permit filling of the ink into the ink container; a pressure reduction source connecting portion connectable with a pressure reduction source for reducing pressure in the ink container to permit filling of the ink; an absorbing material provided in the ink container, the absorbing material is capable of retaining the ink and functioning as a negative pressure source for the recording head; a gas-liquid separating member which is disposed between the absorbing material and the pressure reduction source connecting portion and which has a gas permeability and liquid penetration resisting property; and supporting members, disposed at respective sides of the gas-liquid separating member, for supporting the gas-liquid separating member.

4 Claims, 11 Drawing Sheets

(a)

(b)

(c)

(d)

(a1)

(a2)

(b)

(a)

(b)

(c)

INK JET CARTRIDGE

FIELD OF THE INVENTION AND RELATED ART

The present invention related to an ink jet cartridge comprising: a recording head which records an image by ejecting ink; and an ink container in which the ink to be supplied to the recording head is stored. It also relates to an ink jet recording apparatus employing such an ink jet cartridge. In particular, it relates to an ink jet cartridge reliable in that it is structured so that its ink container can be reliably refilled with ink as necessary, and also, so that the performance of its recording head can be reliably restored as necessary, and also, it relates to an ink jet recording apparatus employing such an ink jet cartridge.

From the standpoint of reducing ink jet printer size, and also, the standpoint of reducing the load which is borne by the carriage of a printer, various proposals have been made. One of such proposals regards a method in which an ink jet cartridge is intermittently refilled with ink (which hereinafter may be simply referred to as pit-stop refill). According to this method, a printer is provided with a small ink container, or a subordinate container, and a large main ink container. The subordinate ink container is mounted on the carrier along with a recording head, whereas the large main ink container is disposed within the printer, but not mounted on the carriage. In operation, the subordinate ink container, or the small ink container, is intermittently connected with the main ink container, and is refilled with the ink from the main ink container, as necessary, at a predetermined location.

A pit-stop refilling method can reduce the load which weighs down the carriage, making it thereby possible to move the carriage at a higher speed. In addition, according to the pit-stop refilling method, an ink jet recording apparatus is provided with the main ink container from which ink is supplied to the subordinate ink container. Therefore, the total amount of the ink mountable in the ink jet recording apparatus can be increased as much as possible, without affecting the amount of the load which weighs down on the carriage, as long as the internal space of the apparatus affords it. Further, the subordinate ink container does not need to be always connected to the main ink container, making it possible to substantially simplify an ink jet recording apparatus in structure.

As for a typical ink jet cartridge employing a pit-stop ink refilling method such as the one described above, the ink jet cartridge disclosed in Japanese Laid-open Patent Application 200-334982 can be listed. In the case of the ink jet cartridge in Japanese Laid-open Patent Application 200-334982, ink can be pulled into the ink jet cartridge through the ink inlet thereof, by the negative pressure generated in the ink jet cartridge through the suction hole thereof. The suction hole is provided with a gas permeable member, that is, a member which allows gas to pass through while preventing liquid from doing so. Thus, as the body of ink having been suctioned into the ink jet cartridge reaches the gas-permeable member, it becomes impossible to continue the suction of the ink jet cartridge. In other words, the gas-permeable member plays the role of a fill-up check valve; it stops the ink refilling process.

As described above, in the case of the ink jet cartridge in accordance with the prior arts, as the ink jet cartridge is suctioned through the suction hole thereof in order to refill the ink jet cartridge by drawing ink into the ink jet cartridge, the gas-permeable member is deformed toward the suction hole by the negative pressure generated by the suction, as shown in FIG. 4(*a*). Also in the case of the ink jet cartridge in accordance with the prior arts, as the ink jet cartridge, the recording head of which has been clogged with ink, is auctioned to restore the performance of the recording head, the gas-permeable member is deformed toward the ink storage portion by the negative pressure generated by the suction, as shown in FIG. 4(*b*). The operation for refilling the ink let cartridge with ink, and the operation for restoring the performance of the ink jet cartridge, are repeated a substantial number of times, that is, from hundreds to as high as thousands of times, for the duration of the service life of the ink jet cartridge, and as the ink refilling operation, and/or performance recovery operation, is repeated hundreds to thousands of times, the gas-permeable member is repeatedly deformed the same number of times toward the suction hole or the liquid storage portion, being thereby mechanically deteriorated. Thus, the ink jet cartridge in accordance with the prior arts sometimes creates the situation in which ink leaks through the gas-permeable member due to the above described mechanical deterioration of the gas-permeable member.

SUMMARY OF THE INVENTION

The present invention was made to solve the above described problem, and its primary object is to provide a reliable ink jet cartridge of a pit-stop ink refill type, which is reliable in that its gas-permeable member is less likely to be deteriorated by the repetition of the cartridge suction necessary for refilling the ink jet cartridge and restoring the performance of the ink jet cartridge, and therefore, less likely to leak ink due to the deterioration of the gas-permeable member, and also to provide an ink jet recording apparatus employing such an ink jet cartridge.

The present invention is characterized in that for the purpose of accomplishing the above object, an ink jet cartridge is provided with: an ink jet recording head; an ink container for storing the ink to be supplied to the recording head; a connective portion connectible to an ink supply source to make the ink container refillable with ink; a connective portion connectible to a pressure reduction source to reduce the internal pressure reduction source to refill the ink container with ink; an absorbent member capable of holding ink, and disposed, as a source for providing the recording head with a certain amount of negative pressure, within the ink container; a gas-permeable member, that is, a member which allows gas to pass through, but does not allow liquid to do so, disposed between the absorbent member and the pressure reduction connective portion; and a pair of holding members which are partially in contact with the inward and outward surfaces, one for one, of the gas-permeable member, and hold the gas-permeable member.

The above described gas-permeable member is desired to be a porous member formed of polytetrafluoroethylene or a substance similar in properties thereto.

According to another characteristic aspect of the present invention, the gas-permeable member is processed for water repellence.

According to another characteristic aspect of the present invention, an ink jet recording apparatus comprises:

a carriage, on which an ink jet cartridge comprising: an ink jet recording head; an ink container for storing the ink to be supplied to the recording head; a first connective portion connectible to an ink supply source to make the ink container refillable with ink; a second connective portion connectible to a pressure reduction source to reduce the internal pressure of the ink container to refill the ink container with ink; an absorbent member capable of holding ink, and disposed, as a source for providing the recording head with a certain amount of negative pressure, within the ink container; a gas-permeable member, that is, a member which allows gas to pass through, but does not allow liquid to do so, disposed between the absorbent member and the second connective portion; and a pair of holding members which are partially in contact with the inward and outward surfaces, one for one, of the gas-permeable member, and hold the gas-permeable member, is mounted;

an ink supply source which can be connected to, or disconnected from, the first connective portion of the ink container by a connective tube;

a negative pressure source which can be connected to, or disconnected from, the second connective portion of the ink container by a connective tube; and a suctioning means connectible to the recording head to restore the performance of the recording head by suction.

These and other objects, features and advantages of the present invention will become more apparent upon consideration of the following description of the preferred embodiments of the present invention, taken in conjunction with the accompanying drawings.

BRIE DESCRIPTION OF THE DRAWINGS

FIG. 1 is a sectional view of the ink jet cartridge in the first embodiment of the present invention.

FIGS. 2(*a*)–2(*d*) are plan views of the essential components of the ink jet cartridge in FIG. 1, as seen from the direction indicated by an arrow mark A in FIG. 1, showing them individually, one for one.

Figure 5:
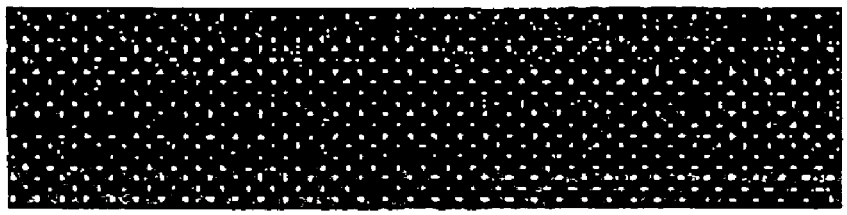
Figure 5:
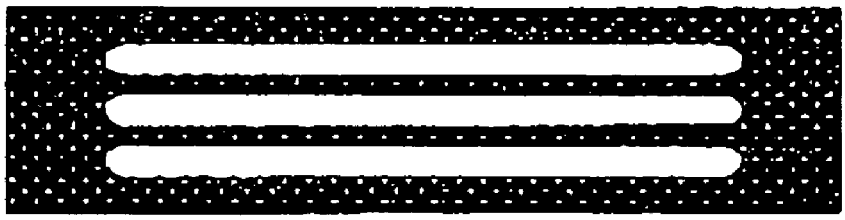
Figure 5:
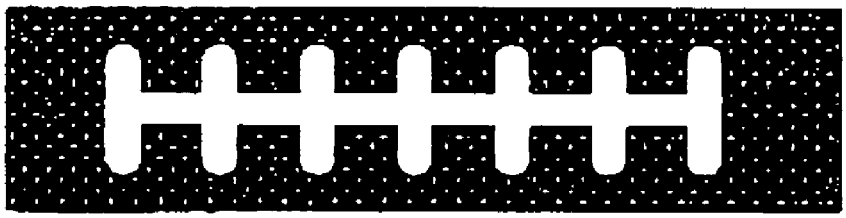
Figure 5:
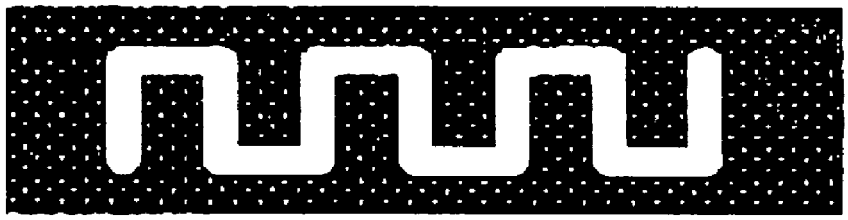

FIGS. 5(*a*)–5(*d*) are plan views of various gas-permeable member holding members employable by the ink jet cartridge in the second embodiment to hold the gas-permeable member thereof.

Figure 6:
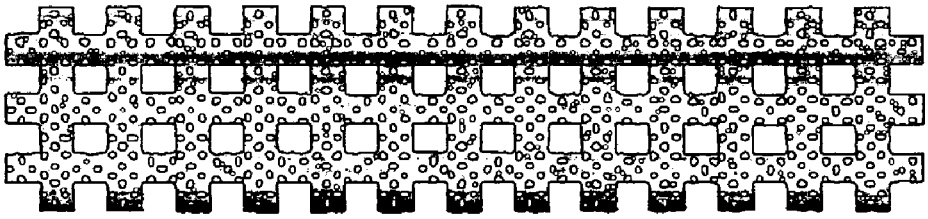
Figure 6:
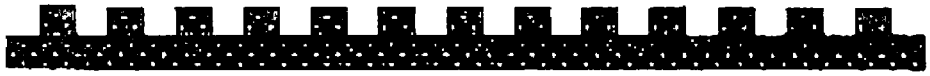
Figure 6:
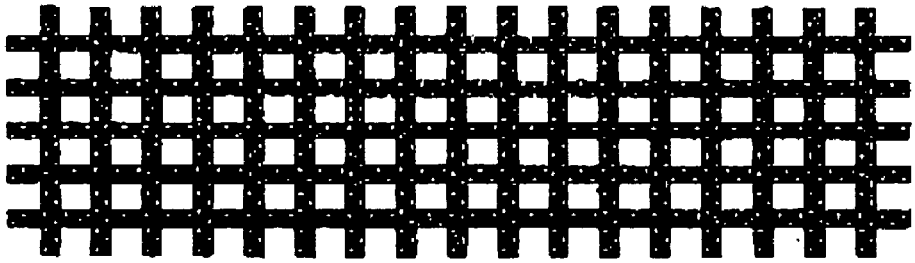

FIGS. 6(*a*) and 6(*b*) are drawings for showing the gas-permeable member holding members different in structure from those shown in FIGS. 5(*a*)–5(*d*).

Figure 7:
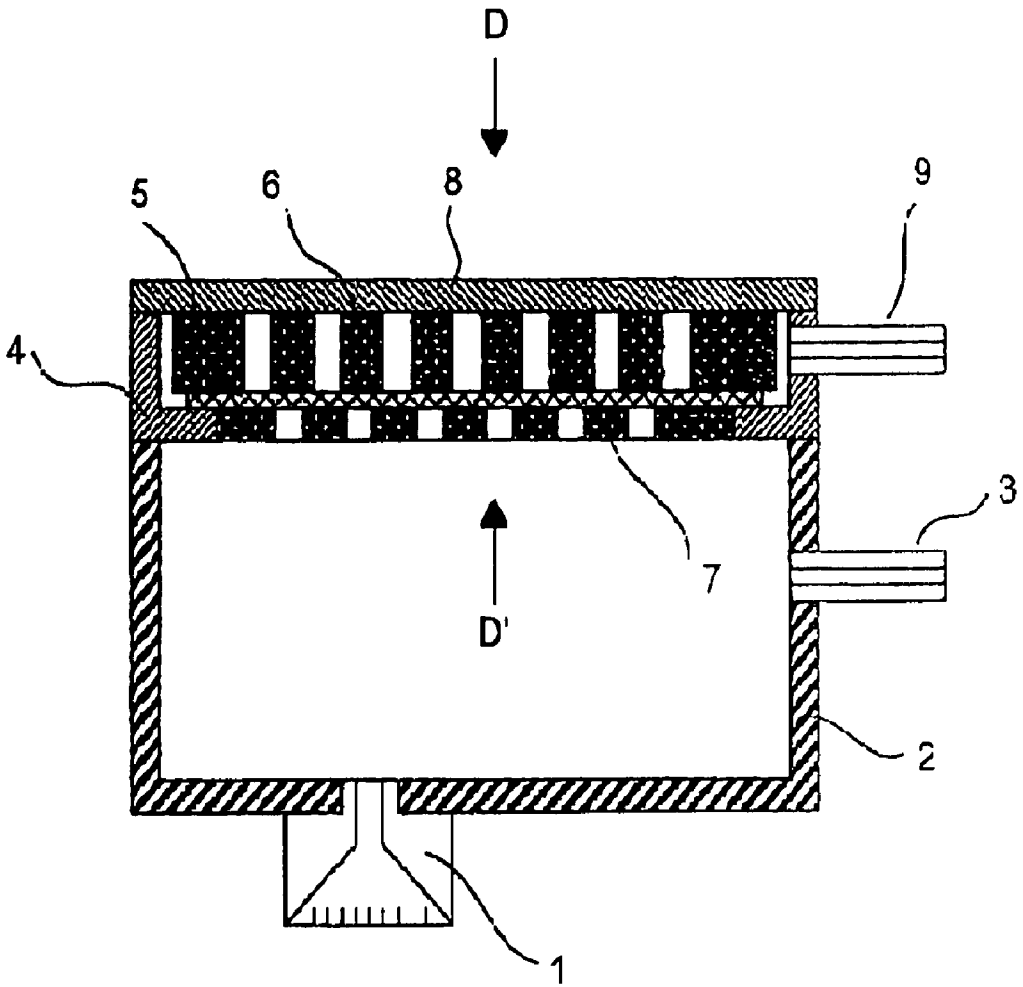

FIG. 7 is a schematic sectional view of the ink jet cartridge in the third embodiment of the present invention.

Figure 8:
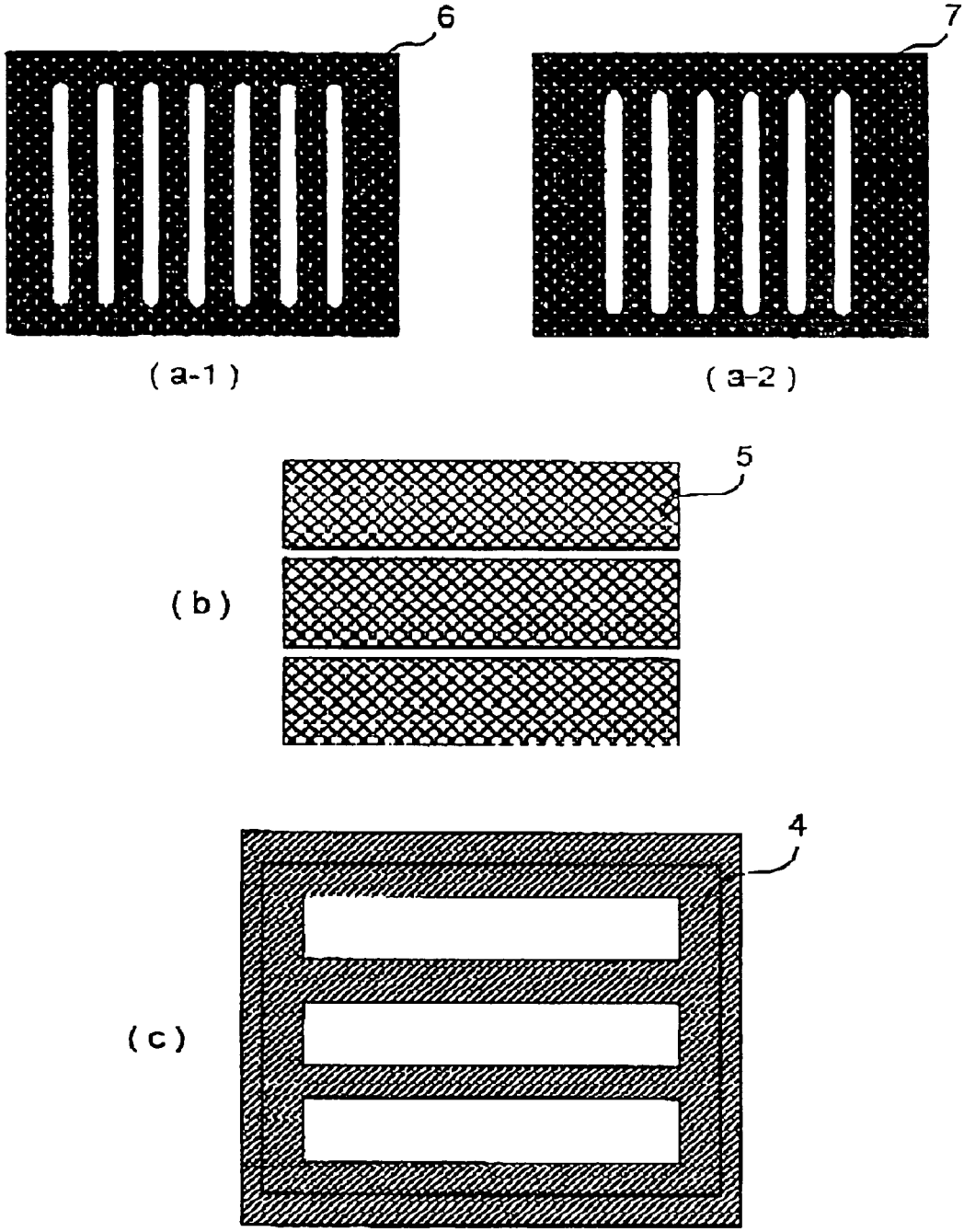

FIGS. 8(*a*)–8(*c*) are plan views of the essential components of the ink jet cartridge in FIG. 8, as seen from the direction indicated by an arrow mark D in FIG. 6, individually showing them.

Figure 9:
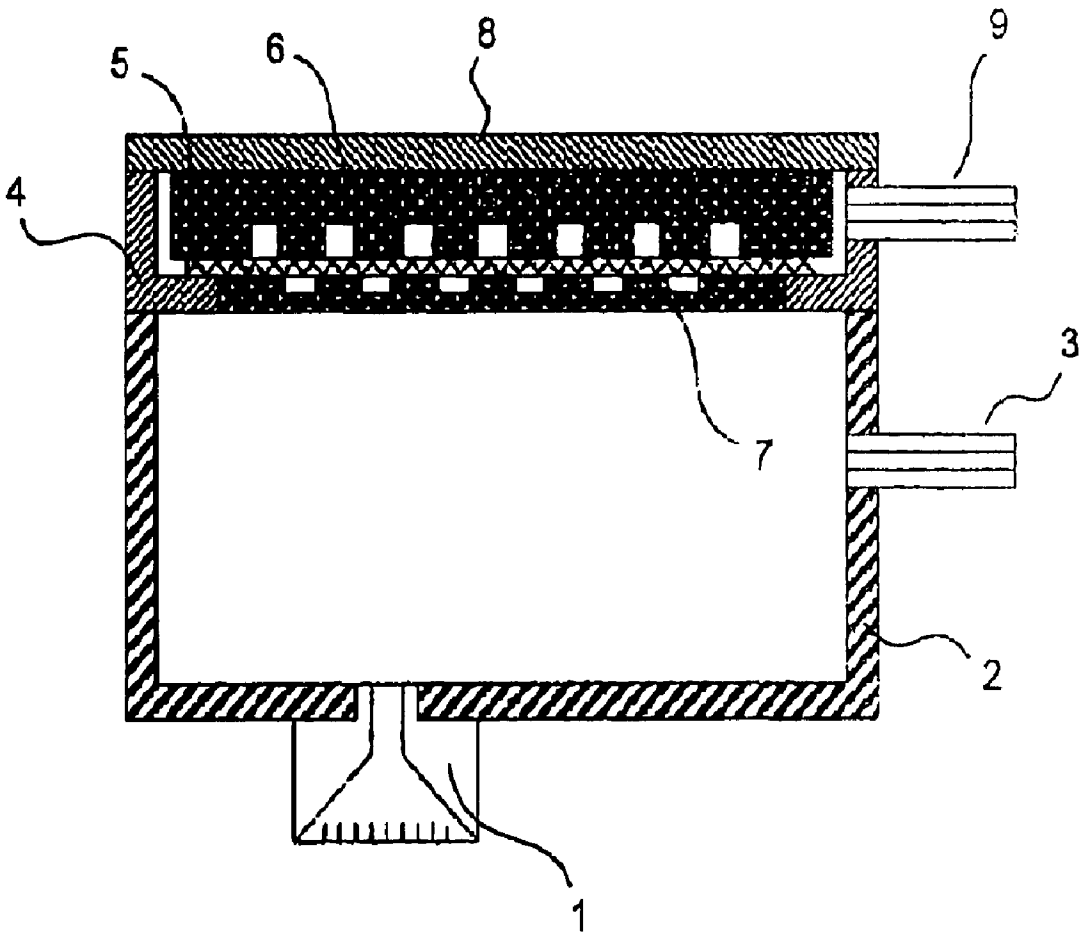

FIG. 9 is a schematic sectional view of the ink jet cartridge in the fourth embodiment of the present invention.

Figure 10:
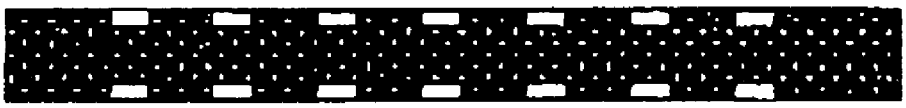
Figure 10:
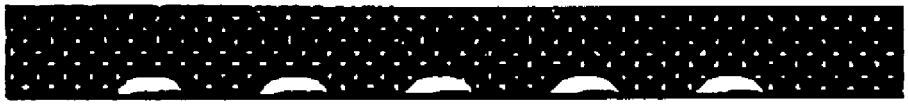
Figure 10:
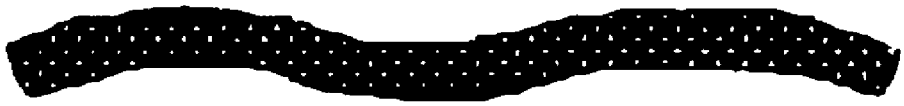

FIGS. 10(*a*)–10(*b*) are sectional views of the gas-permeable member of the ink jet cartridge in the fifth embodiment of the present invention.

Figure 11:
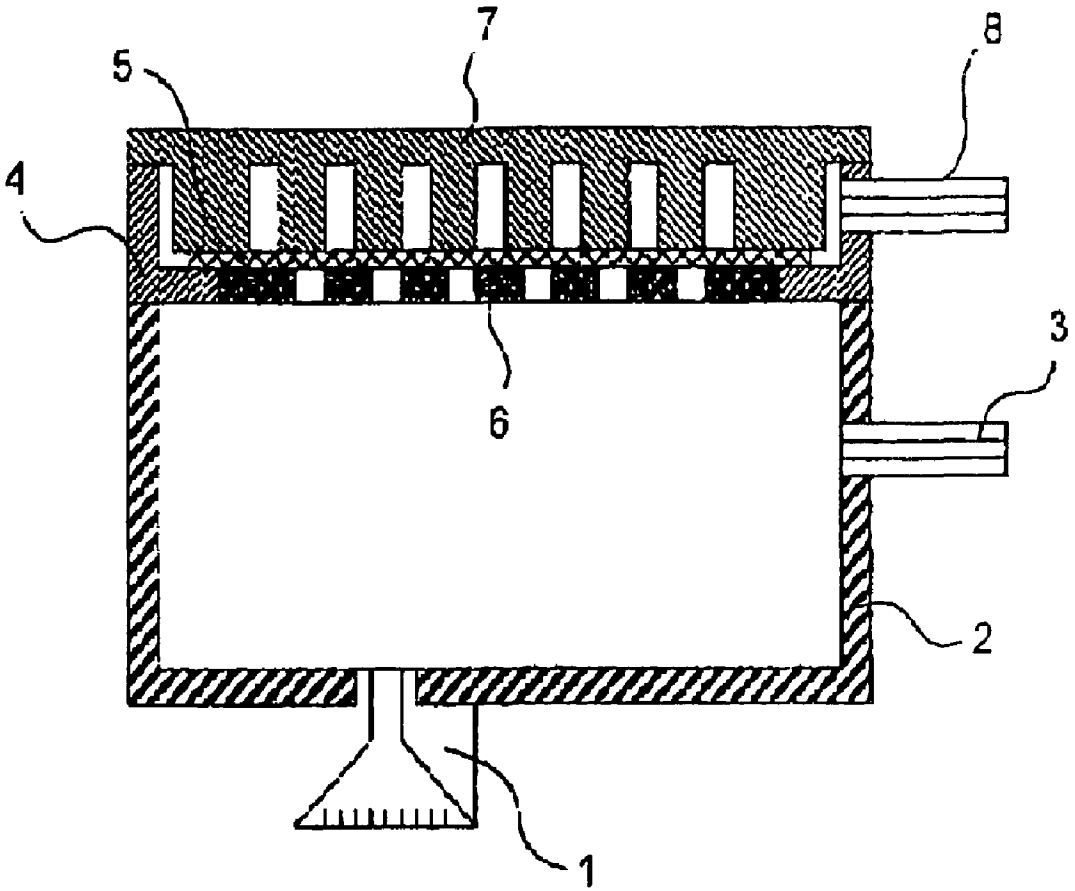

FIG. 11 is a schematic sectional view of the ink jet cartridge in the sixth embodiment of the present invention.

DETAILED DESCRIPTION OF THE PREFERRED EMBODIMENTS

Hereinafter the preferred embodiments of the present invention will be described.

Embodiment 1

Figure 1:
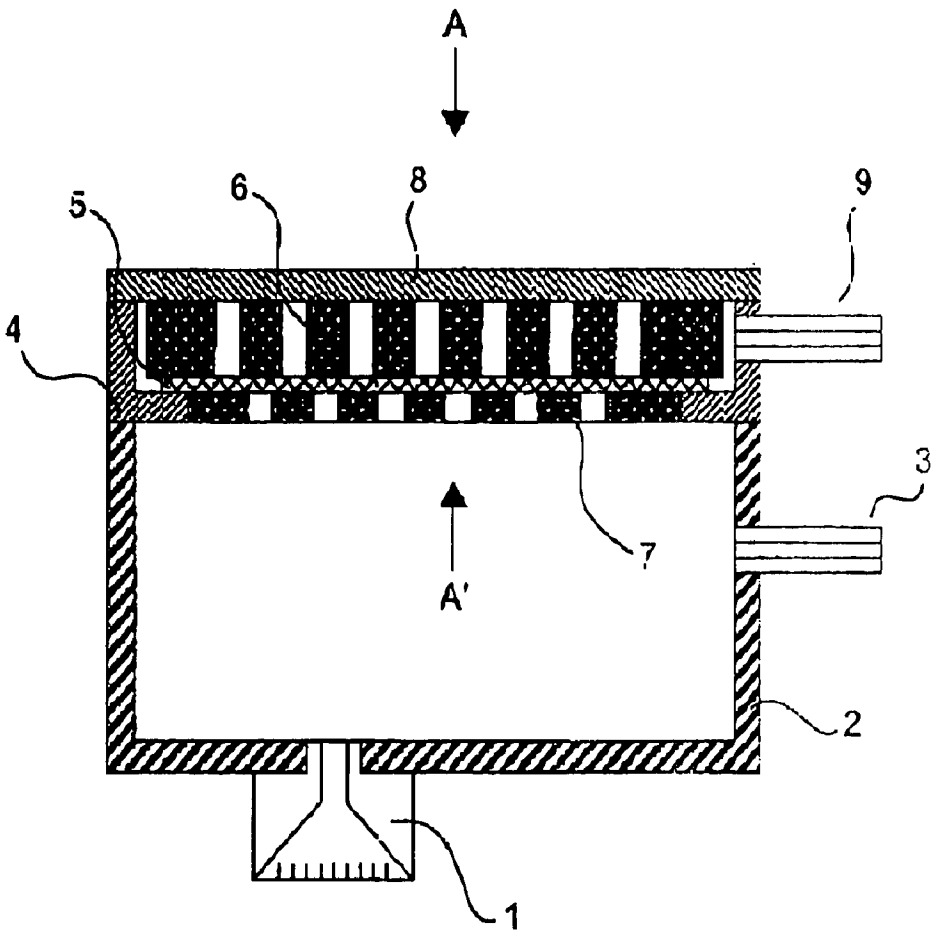

FIG. 1 is a sectional view of the ink jet cartridge in the first embodiment of the present invention.

Designated by a referential numeral 1 is an ejection unit for liquid ejection. As the recording head becomes clogged with ink, the liquid ejection orifices of the recording head are capped with a suction cap, that is, a head cap. Designated by a referential numeral 2 is a liquid storage chamber in which the liquid to be supplied to the ejection unit is stored (hereinafter, the liquid to be ejected from the recording head in this embodiment will be referred to as ink). The liquid storage chamber 2 is filled with a piece of absorbent substance (unknown) for absorbing ink and retaining it therein. A referential numeral 3 designates a liquid inlet to be connected with a main liquid container (unshown), and a referential numeral 4 designates an intermediary lid for sealing the liquid storage chamber 2. A referential numeral 5 designates a gas-permeable member, and a referential numeral 6 designates a gas-permeable member holding (backing) member for holding down the gas-permeable member 5. A referential numeral 7 designates a gas-permeable member holding (backing) member for holding up the gas-permeable member 5, and a referential numeral 8 designates a top lid attached to the intermediary lid 4. A referential numeral 9 designates an air vent to be connected to a suction pump. The gas-permeable member 5 in this embodiment is a porous member.

Figure 2:
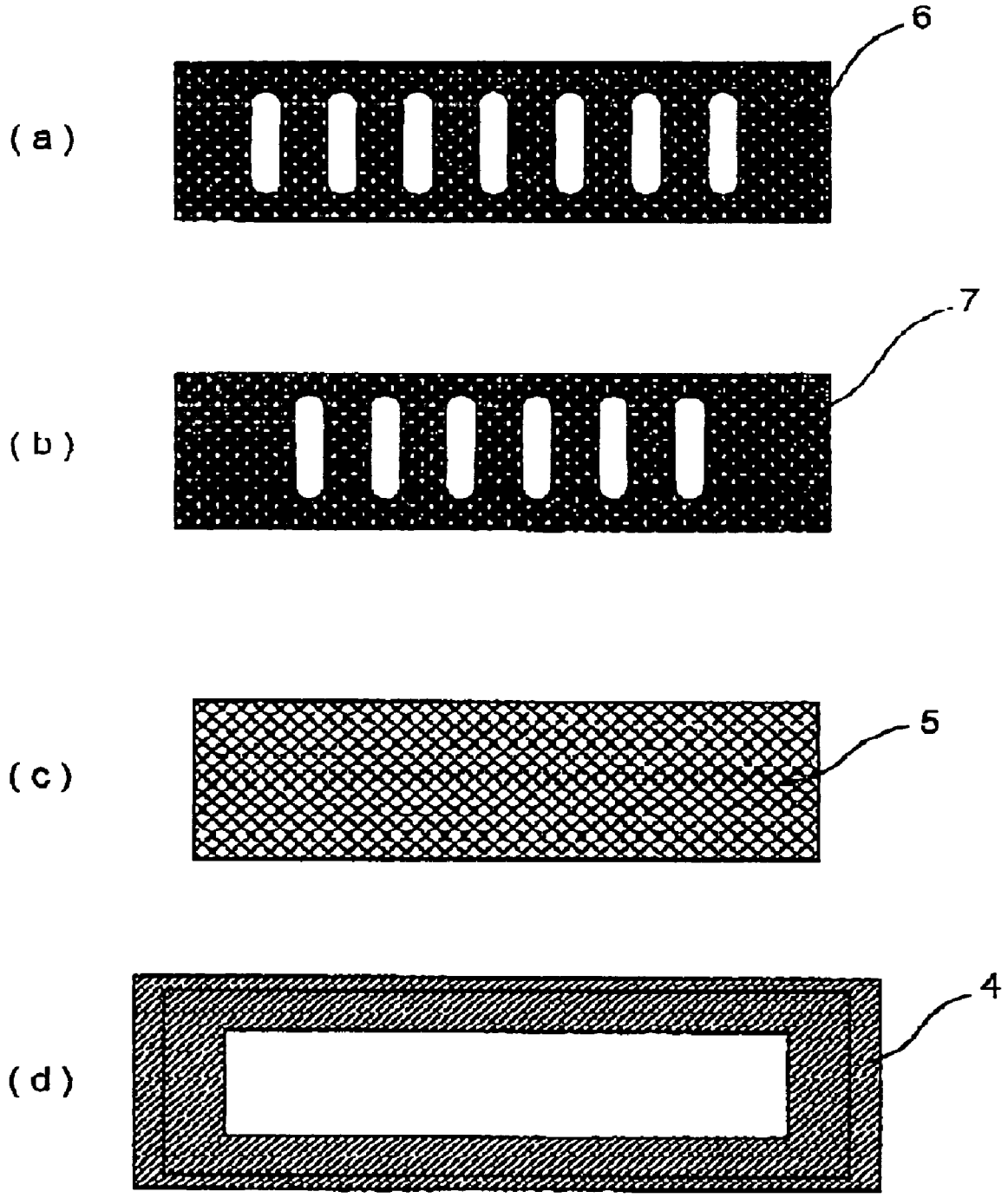

FIGS. 2(*a*)–2(*d*) are plan views of the essential components, one for one, of the ink jet cartridge in this embodiment, as seen from the direction indicated by an arrow mark A in FIG. 1; (*a*)–(*d*) showing the gas-permeable member holding member 6, gas-permeable member holding member 7, gas-permeable member 5, and intermediary lid 4, respectively.

Referring to FIGS. 1 and 2, the intermediary lid 4 is provided with a hole, and the gas-permeable member 5 is placed in the recess of the intermediary lid 4, covering the hole of the intermediary lid 4. The gas-permeable member holding members 6 and 7 are formed of porous material, and are disposed in contact with the gas-permeable member 5, across the top and bottom surfaces, respectively. These gas-permeable member holding members 6 and 7 each are provided with a certain number of holes.

Figure 3:
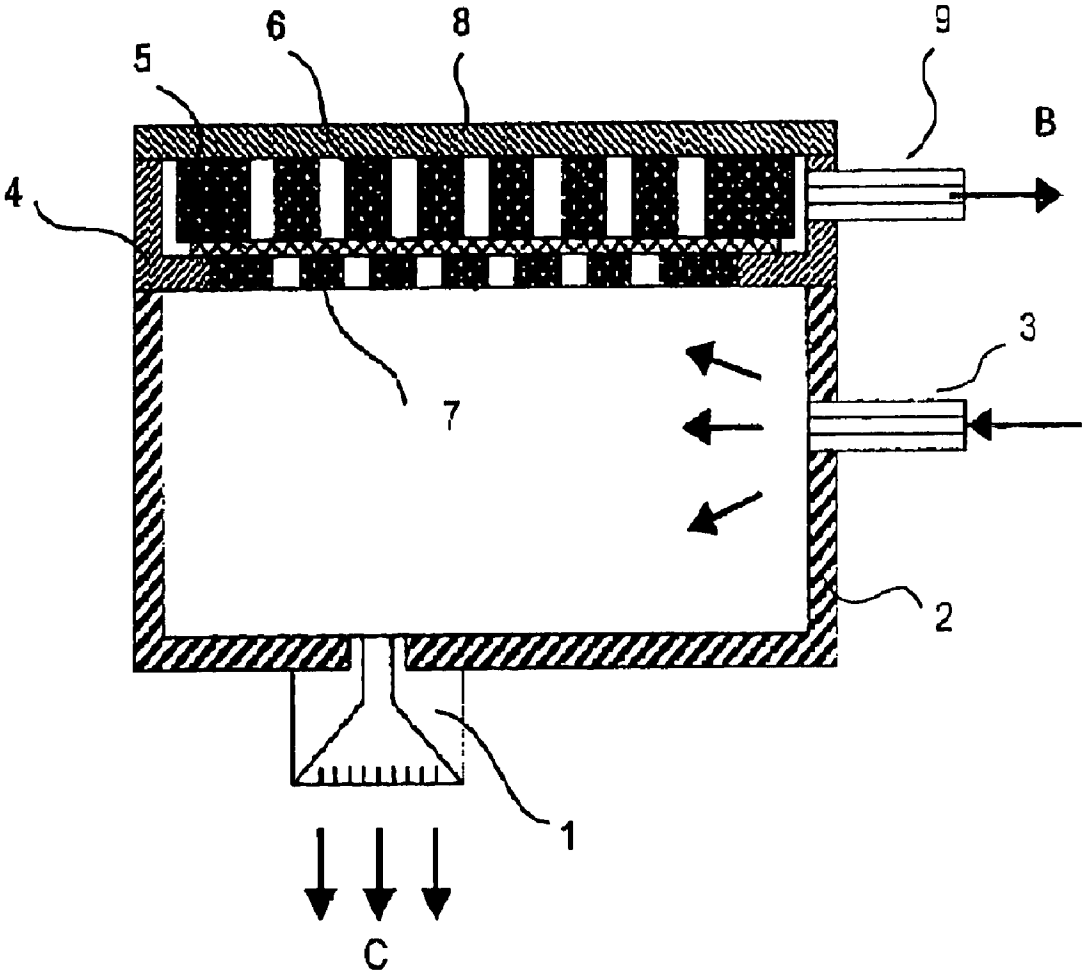
FIG. 3 is a schematic drawing for describing the pit-stop refilling of the ink jet cartridge with ink, in the first embodiment.

FIG. 3 is a drawing for describing the pit-stop refilling of the ink jet cartridge with ink, in this embodiment.

Referring to FIG. 3, ink is flowed (supplied) into the liquid storage chamber 2 through the liquid inlet 3, by suctioning (B) air out of the liquid storage chamber 2 through the air vent 9 with the use of a suction pump. There is the gas-permeable member holding member 6 on the gas-permeable member 5. Therefore, as the pressure is applied to the gas-permeable member 5 by the suction (D), the gas-permeable member holding member 6 backs up the gas-permeable permeable member 5, reducing thereby the effects the pressure resulting from the suction (B). Therefore, virtually no change occurs to the shape of the gas-permeable member 5. Also referring to FIG. 3, when it is necessary to unclog the ink jet cartridge to restore the performance of the recording head, the liquid storage chamber 2 is suctioned (C) by a suction pump through the ejection unit 1. In this case, as pressure applies to the gas-permeable member due to the suction (C), the gas-permeable member holding member 7 under the gas-permeable member 5 backs up the gas-permeable member 5, bearing a part of the pressure. Therefore, virtually no deformation occurs to the gas-permeable member.

Figure 4:
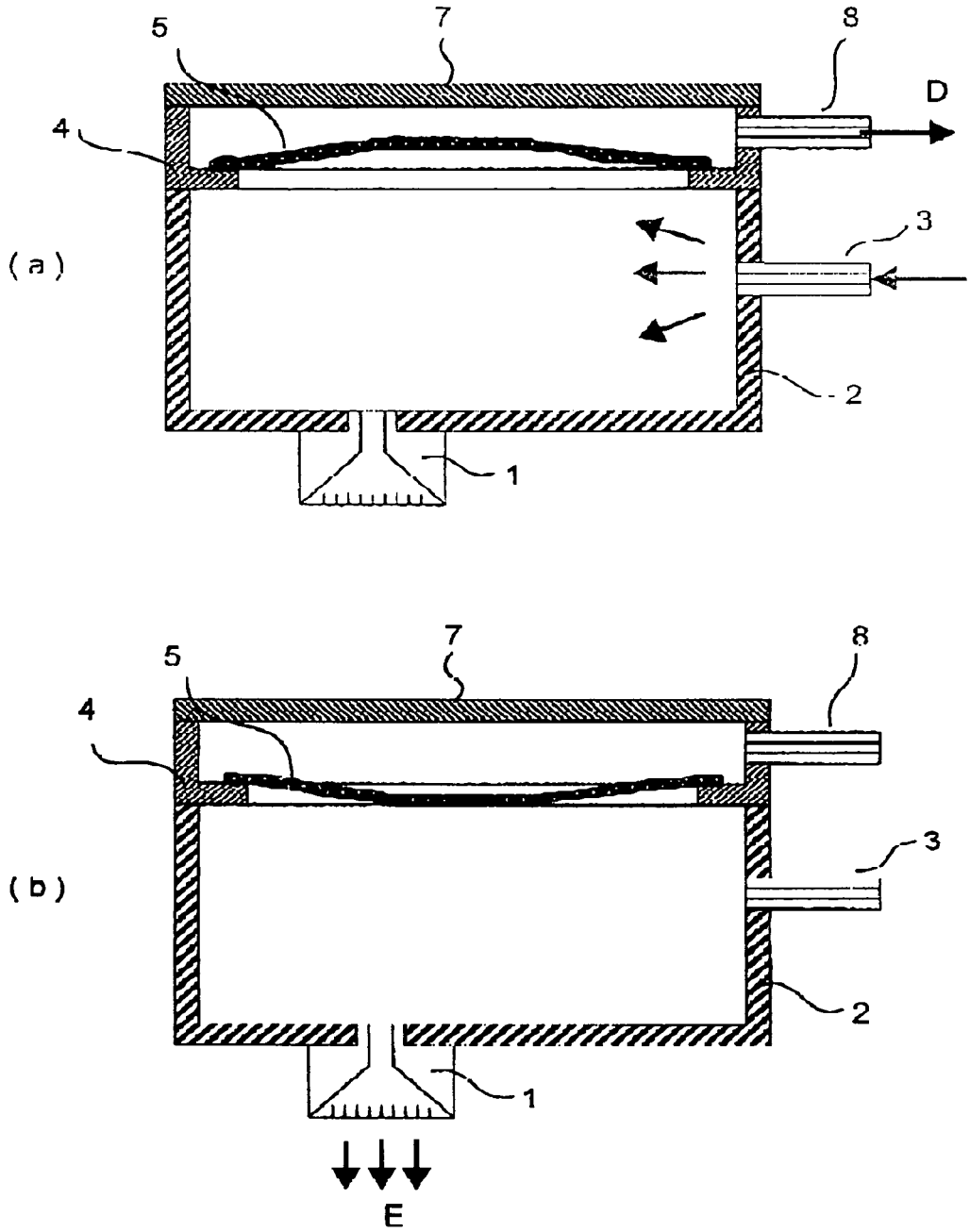
FIG. 4 is a schematic drawing for describing the pit-stop refilling of the ink jet cartridge with ink, in accordance with the prior arts.

FIGS. 4(*a*) and 4(*b*) are schematic sectional views of a comparative ink jet cartridge, that is, an ink jet cartridge which does not have the gas-permeable member holding member 6, showing how the ink jet cartridge is supplied with ink during a pit-stop refill.

Referring to FIG. 4(*a*), ink is flowed (supplied) into the liquid storage chamber 2 by suctioning the liquid storage chamber 2 by a suction pump through the air vent 8. In the case of this ink jet cartridge, however, there is no gas-permeable member holding member 6 on the gas-permeable member 5. Therefore, the entirety of the pressure generated by the suction pump is borne by the gas-permeable member 5 alone, deforming thereby the gas permeable member 5. This deformation of the gas-permeable member 5 occurs each time the ink jet cartridge is refilled. Thus, if the ink jet cartridge is repeatedly refilled with ink, the gas-permeable member 5 deteriorates, making it possible for the ink to leak through the gas-permeable member 5.

Next, referring to FIG. 4(*b*), when it is necessary to unclog the ink jet cartridge in order to restore the performance of the recording head, the ink storage chamber 2 is auctioned (E) by a suction pump through the ejection unit 1. In the case of this ink jet cartridge, there is no gas-permeable member holding member 7 under the gas-permeable member 5. Therefore, the entirety of the pressure generated by the suction (E) is borne by the gas-permeable member 5 alone, deforming thereby the gas-permeable member 5. Thus, it this ink jet cartridge is repeatedly refilled with ink, the gas-permeable member 5 deteriorates, making it possible for the ink to leak through the gas-permeable member 5.

Embodiment 2

The sectional view of the ink jet cartridge in this second embodiment of the present invention is similar to the sectional view of the ink jet cartridge shown in FIG. 1; the ink jet cartridge in this embodiment is virtually the same as that in the first embodiment, except for the configurations of the gas-permeable member holding members 6 and 7. FIGS. 5(*a*)–5(*d*) show various patterns feasible as the configuration for the gas-permeable member holding member 6 or 7, as seen from the direction indicated by the arrow mark A or an arrow mark A' in FIG. 1.

The gas-permeable member holding member 6 shown in FIG. 5(*a*) is not provided with a hole, but is formed of porous material, allowing thereby gaseous substance to easily pass through it.

The gas-permeable member holding member 6 shown in FIG. 5(*b*) has elongated holes which extend in the lengthwise direction of the ink jet cartridge.

The gas-permeable member holding member 6 shown in FIG. 5(*c*) has a compound hole, which is a combination of a single long elongated hole parallel to the lengthwise direction of the ink jet cartridge, and a certain number of short elongated holes disposed in parallel, with equal intervals, in the direction perpendicular to the long elongated hole.

The gas-permeable member holding member 6 shown in FIG. 5(*d*) has a long and narrow hole extending in an apparent zigzag pattern.

Shown in FIG. 6 are additional structures for the gas-permeable member holding member 6 or 7.

FIG. 6(*a*1) shows the lattice-like structure feasible for the gas-permeable member holding members 6 and 7, as seen from the direction indicated by an arrow mark A or A' in FIG. 1, and FIG. 6(*a*2) is a sectional view of the lattice-like structure feasible for the gas-permeable member holding members 6 and 7. In the case of this structure, the bottom surface of each of the strips extending in parallel in the direction perpendicular to the lengthwise direction of tho ink jet cartridge is in contact with the top surface of each of the strips extending in the lengthwise direction of the ink jet cartridge.

FIG. 6(*b*) is a schematic plan view of the structure feasible also for the gas-permeable member holding members 6 and 7, as seen from the direction indicated by the arrow mark A or A' in FIG. 1. In the case of this structure, the strips extending in parallel in the direction perpendicular to the lengthwise direction of the ink jet cartridge, and the strips extending in the lengthwise direction of the ink jet cartridge, are much narrower than the counterparts in FIG. 6(*a*), and the former are perpendicular to the latter, effecting a mesh-like pattern.

No matter which of the structures shown in FIGS. 5 and 6 is employed as the structure for the gas-permeable member holding members 6 and 7, the substantial portion of the pressure which applies to the gas-permeable member 5 during the pit-stop refilling of the ink jet cartridge, or unclogging of the ink jet cartridge, is borne by the gas-permeable member holding member 6 or 7, substantially reducing thereby the stress to which the gas-permeable member 5 is subjected by the pressure, virtually eliminating the deformation of this gas-permeable member 5.

Embodiment 3

FIG. 7 is a schematic sectional view of the ink jet cartridge in the third embodiment of the present invention.

Designated by a referential numeral 1 is an ejection unit for liquid ejection, and designated by a referential numeral 2 is a liquid storage chamber in which the liquid to be applied to the ejection unit is stored (hereinafter, the liquid to be ejected from the recording head in this embodiment will be referred to as ink). The liquid storage chamber 2 is filled with a piece of absorbent substance (unshown) for absorbing ink and retaining it therein. A referential numeral 3 designates a liquid inlet to be connected with a main liquid container (unshown) and a referential numeral 4 designates an intermediary lid for keeping the liquid storage chamber 2 virtually sealed. A referential numeral 5 designates a gas-permeable member, and a referential numeral 6 designates a holding member for holding down the gas-permeable member 5, and a referential numeral 7 designates a holding member for holding up the gas-permeable member 5, and a referential numeral 8 designates a top lid attached to the intermediary lid 4. A referential numeral 9 designates an air vent to be connected to a suction pump. The gas-permeable member 5 in this embodiment is a porous member.

FIGS. 8(*a*)–8(*c*) are plan views of the essential components of the ink jet cartridge in this embodiment, as seen from the direction indicated by an rrow mark D or D' in FIG. 7; (*a*-1) and (*a*-2) showing the gas-permeable member holding members 6 and 7, respectively, and (b) and (c) showing the gas-permeable member 5 and intermediary lid 4, respectively.

Referring to FIGS. 7 and 8, the intermediary lid 4 has three holes which lead to the three liquid storage chambers (unshown), and holds three gas-permeable members 5, blocking the three holes thereof. Further, the ink jet cartridge has two gas-permeable member holding members 6 and 7, which are disposed in contact with the top and bottom surfaces, respectively, of each of the gas-permeable members 5, holding down, and holding up, the gas permeable members 5, respectively. The gas-permeable member holding members 6 and 7 in this embodiment are provided with a certain number of holes.

In this embodiment, two gas-permeable member holding members 6 and 7 are provided for multiple (three in this embodiment) gas-permeable members 5. However, the effect of this structural arrangement is the same as that in the first embodiment; the substantial portion of the pressure which applies to the gas-permeable members 5 during the pit-stop refilling of the ink jet cartridge is borne by the gas-permeable member holding members 6 or 7, substantially reducing the amount of the stress to which the gas-permeable member is subjected by the pressure, virtually eliminating the deformation of the gas-permeable member 5.

Embodiment 4

FIG. 9 is a schematic sectional view of the ink jet cartridge in the fourth embodiment of the present invention.

Designated by a referential numeral 1 is an ejection unit for liquid ejection, and designated by a referential numeral 2 is a liquid storage chamber in which the liquid to be supplied to the ejection unit is stored (hereinafter, the liquid to be ejected from the recording head in this embodiment will be referred to as ink). The liquid storage chamber 2 is filled with a piece of absorbent substance (unknown) for absorbing ink and retaining it therein. A referential numeral 3 designates a liquid inlet to be connected with the main liquid container (unshown), and a referential numeral 4 designates an intermediary lid for keeping the liquid storage chamber 2 virtually sealed. A referential numeral 5 designates a gas-permeable member, which is in the recess of the intermediary lid 4. A referential numeral 6 designates a gas-permeable member holding member for holding down the gas-permeable member 5. A referential numeral 7 designates a gas-permeable member holding member for holding up the gas-permeable member 5, and a referential numeral 8 designates a top lid attached to the intermediary lid 4. A referential numeral 9 designates an air vent to be connected to a suction pump. The gas-permeable member 5 in this embodiment is formed of porous material.

Referring to FIG. 9, the gas-permeable member holding members 6 and 7 in this embodiment each are provided with a certain number of grooves, which are disposed in parallel in the direction perpendicular to the lengthwise direction of the ink jet cartridge. The gas permeable member holding members 6 and 7 in this embodiment are formed of porous material. Also in the case of this embodiment, the substantial portion of the pressure which applies to the gas-permeable members 5 during the pit-stop refilling of the ink jet cartridge is borne by the gas-permeable member holding member 6 or 7, substantially reducing the amount of the stress to which the gas-permeable member 5 is subjected by the gas-permeable members 5, as in the case of the first embodiment.

Embodiment 5

The sectional view of the ink jet cartridge in the sixth embodiment of the present invention is virtually identical to FIG. 9. FIG. 10, which is a sectional view, shows only the portions of the ink jet cartridge in this embodiment, equivalent to the gas-permeable member holding member 6 or 7 shown in FIG. 9. In other words, the ink jet cartridge in this embodiment is virtually identical to that shown in FIG. 9, except for the gas-permeable member holding members 6 and 7.

The gas-permeable member holding members 6 and 7 shown in FIG. 10(*a*) are provided with a certain number of grooves with a predetermined depth, which are in the top and bottom surfaces thereof, and are in parallel to the direction perpendicular to the lengthwise direction of the ink jet cartridge.

The gas-permeable member holding members 6 and 7 shown in FIG. 10(*b*) have a certain number of grooves, which are semicircular in vertical section.

The gas-permeable member holding members 6 and 7 shown in FIG. 10(*c*) are shaped so that they look wavy in vertical section.

Also in this embodiment, no matter which of the gas-permeable member holding members 6 and 7 shown in FIGS. 10(*a*)–(*c*) is employed, the substantial portion of the pressure which applies to the gas-permeable member 5 during the pit-stop refilling of the ink jet cartridge is borne by the gas-permeable member holding member 6 or 7, substantially reducing thereby the amount of the stress to which the gas-permeable member 5 is subjected by the pressure, virtually eliminating the deformation of the gas-permeable member 5.

Embodiment 6

FIG. 11 is a schematic sectional view of the ink jet cartridge in the sixth embodiment of the present invention.

Designated by a referential numeral 1 is an ejection unit for liquid ejection, and designated by a referential numeral 2 is a liquid storage chamber in which the liquid to be supplied to the ejection unit is stored (hereinafter, the liquid to be ejected from the recording head in this embodiment will be referred to as ink). The liquid chamber 2 is filled with a piece of absorbent substance (unshown) for absorbing ink and retaining it therein. A referential numeral 3 designates a liquid inlet to be connected with the main liquid container (unshown), and a referential numeral 4 designates an intermediary lid for keeping the liquid storage chamber 2 virtually sealed. A referential numeral 5 designates a gas-permeable member, which is in the recess of the intermediary lid 4. A referential numeral 6 designates a gas-permeable member holding member placed in contact with the bottom surface of the gas-permeable member 5. A referential numeral 7 designates a top lid attached to the intermediary lid 4, and a referential numeral 8 designates an air vent to be connected to a suction pump. The gas-permeable member 5 in this embodiment is a porous member.

In this embodiment, the top lid 7 is provided with a certain number of projections which are in contact with the gas-permeable member 5. Thus, the top lid 7 also plays the role of gas-permeable member holding member while functioning as a top lid.

Also in the case of this embodiment, the substantial portion of the pressure which applies to the gas-permeable member 5 during the pit-stop refilling of the ink jet cartridge is borne by the gas-permeable member holding member 6 or 7, substantially reducing thereby the amount of the stress to which the gas-permeable member 5 is subjected by the pressure, virtually eliminating the deformation of the gas-permeable member 5.

In this embodiment, the top lid 7 is attached to the intermediary lid 4 so that it remains in contact with the gas-permeable member 5. However, there may be a gap between the top lid 7 and gas-permeable member 5, as long as the top lid 7 is positioned so that the substantial portion of the pressure which applies to the gas-permeable member 5 during the pit-stop refilling of the ink jet cartridge with ink is borne by the top lid 7. Such placement of the top lid 7 is within the scope of the present invention.

As described above, according to the present invention, the substantial portion of the pressure which applies to the gas-permeable member of an ink jet cartridge during the pit-stop refilling of the ink jet cartridge with ink is borne by the gas-permeable member holding member, substantially reducing the amount of the stress to which the gas-permeable member is subjected during the pit-stop refilling, reducing thereby the amount of the deformation of the gas-permeable member. Thus, the present invention makes it possible to provide a reliable and durable ink jet cartridge of a pit-stop refill type, which is reliable and durable in that it can be subjected to the pit-stop refill operation a substantially larger number of times without being affected in its performance, compared to a refillable ink jet cartridge in accordance with the prior arts.

While the invention has been described with reference to the structures disclosed herein, it is not confined to the details set forth, and this application is intended to cover such modifications or changes as may come within the purposes of the improvements or the scope of the following claims.

What is claimed is:

1. An ink jet cartridge comprising:

an ink jet recording head;

an ink container for containing ink to be supplied to said recording head;

an ink supply source connecting portion which is provided in said ink container and which is connectable with an ink supply source to permit filling of the ink into said ink container;

a pressure reduction source connecting portion connectable with a pressure reduction source for reducing pressure in said ink container to permit filling of the ink;

an absorbing material provided in said ink container, said absorbing material is capable of retaining the ink and functioning as a negative pressure source for the recording head;

a gas-liquid separating member which is disposed between said absorbing material and said pressure reduction source connecting portion and which has a gas permeability and liquid penetration resisting property; and supporting members, disposed at respective sides of said gas liquid separating member, for supporting said gas-liquid separating member.

2. An ink jet cartridge according to claim 1, wherein said gas liquid separating member is made of polytetrafluoroethylene or a material having a property equivalent thereto.

3. An ink jet cartridge according to claim 1, wherein said gas-liquid separating member is given a liquid repelling property.

4. An ink jet recording apparatus comprising:

a carriage for carrying an ink jet cartridge, said ink jet cartridge comprising: a ink jet recording head; a ink container for containing ink to be supplied to said recording head; a ink supply source connecting portion which is provided in said ink container and which is connectable with an ink supply source to permit filling of the ink into said ink container; a pressure reduction source connecting portion connectable with a pressure reduction source for reducing pressure in said ink container to permit filling of the ink; a absorbing material provided in said ink container, said absorbing material is capable of retaining the ink and functioning as a negative pressure source for the recording head; a gas-liquid separating member which is disposed between said absorbing material and said pressure reduction source connecting portion and which has a gas permeability and liquid penetration resisting property; and supporting members, disposed at respective sides of said gas-liquid separating member, for supporting said gas-liquid separating member;

wherein said ink supply source is disconnectably connected with a first connecting portion of said ink container by a communication tube;

a pressure reduction source disconnectably connected with a second connecting portion of said ink container by a connection tube; and a suction recovering source, connected with said recording head, for effecting a recovering operation for said recording head.

* * * * *